United States Patent [19]

Annis et al.

[11] Patent Number: 5,074,171

[45] Date of Patent: Dec. 24, 1991

[54] OPEN-END WRENCH WITH REDUCED SIZE JAWS

[75] Inventors: Jeffrey R. Annis, Waukesha; Richard S. Goergen, Jr.; Frank Mikic, both of Kenosha, all of Wis.; Patrick J. Sampson, Schaumburg, Ill.

[73] Assignee: Snap-on Tools Corporation, Kenosha, Wis.

[21] Appl. No.: 604,103

[22] Filed: Oct. 29, 1990

[51] Int. Cl.[5] ..... B25B 13/02

[52] U.S. Cl. ..... 81/119; 81/121.1

[58] Field of Search ..... 81/119, 121, 122, 125.1

[56] References Cited

U.S. PATENT DOCUMENTS

| | | | |
|---|---|---|---|
| 1,424,676 | 8/1922 | Parsons . | |
| 2,657,603 | 11/1953 | Evans . | |
| 2,687,056 | 8/1954 | Foor . | |
| 2,777,348 | 1/1957 | Wraight | 81/119 |
| 3,121,356 | 2/1964 | Davis . | |
| 3,242,775 | 3/1966 | Hinkle | 81/119 |

FOREIGN PATENT DOCUMENTS

| | | | |
|---|---|---|---|
| 0228067 | 3/1959 | Australia | 81/119 |
| 1309258 | 10/1962 | France | 81/119 |
| 3886 | of 1882 | United Kingdom . | |
| 0508761 | 7/1939 | United Kingdom | 81/119 |

OTHER PUBLICATIONS

U.S. application Ser. No. 487,921 filed Mar. 5, 1990.

*Primary Examiner*—James G. Smith
*Assistant Examiner*—Lawrence Cruz
*Attorney, Agent, or Firm*—Emrich & Dithmar

[57] ABSTRACT

The one-piece, open-end wrenching head includes two substantially equal-length jaws with a throat recess therebetween. The jaws respectively include driving surfaces spaced apart a distance slightly greater than the across-flats dimension of an associated hexagonal fastener, with each driving surface having a length no greater than the length of one of the flat sides of the associated fastener and having a serrated region thereon. The distance from the deepest part of the throat to an imaginary line connecting the distal ends of the jaws is approximately 0.86 times the across-flats dimension of the fastener.

12 Claims, 1 Drawing Sheet

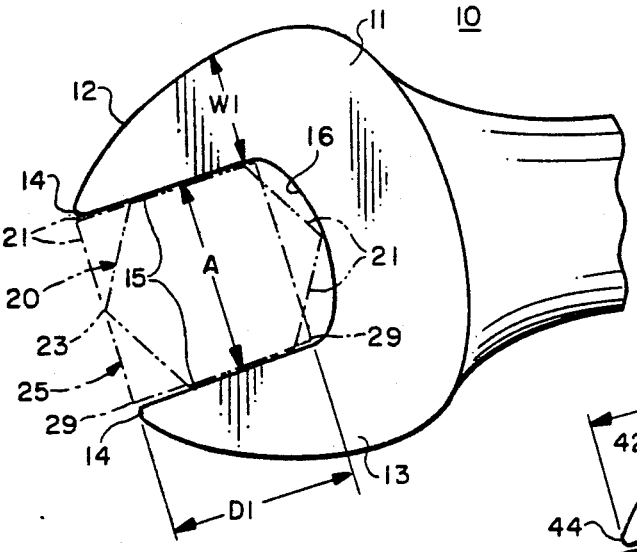
FIG. 1 (PRIOR ART)
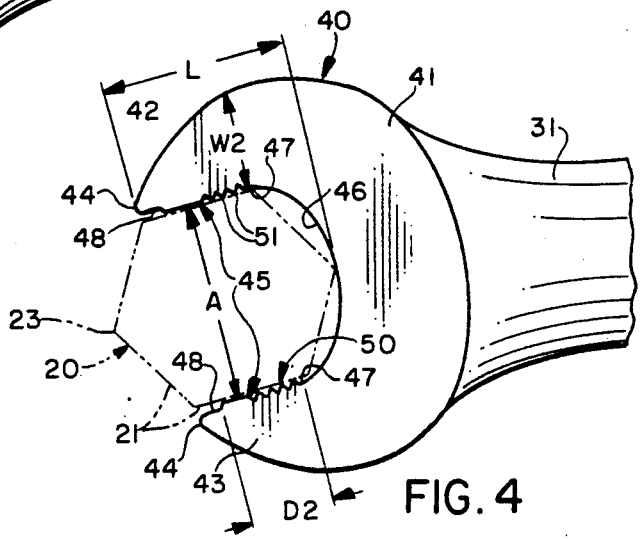
FIG. 4
FIG. 2
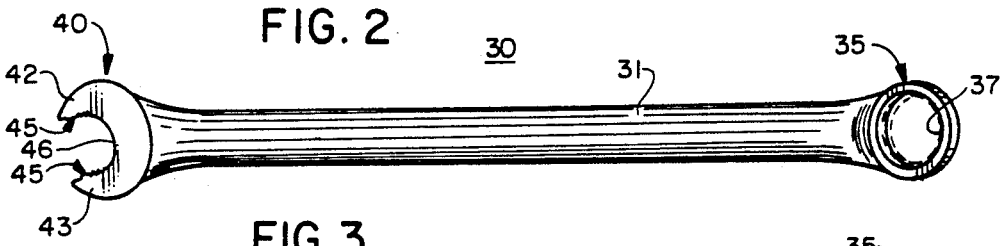
FIG. 3
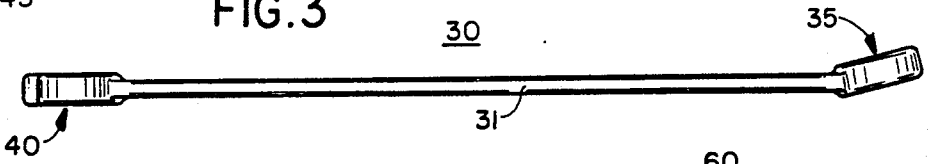
FIG. 5
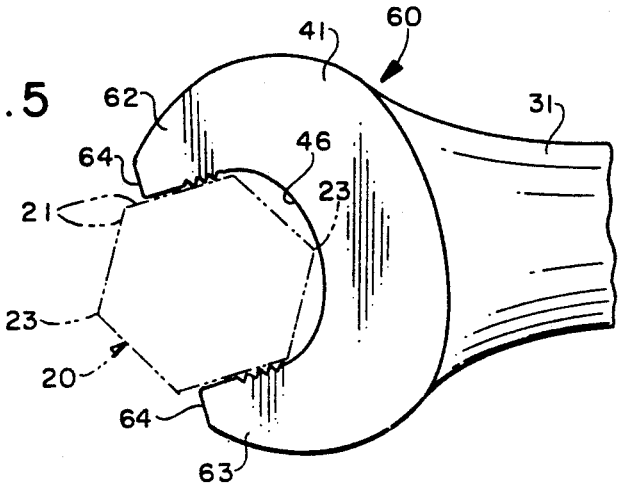

OPEN-END WRENCH WITH REDUCED SIZE JAWS

BACKGROUND OF THE INVENTION

1. Field of the Invention

The present invention relates to open-end wrenches and specifically to the construction of the wrenching head of such a wrench.

2. Description of the Prior Art

A typical open-end wrench consists of an elongated handle shank and a wrenching head on either or both ends thereof, the head including two jaws, respectively provided with smooth planar driving surfaces that engage opposite sides of a polygonal fastener.

A disadvantage of such wrenches has been the inadequate gripping force between the driving surfaces and the fastener. As a result, the wrench has a tendency to slip off the fastener when torque is applied thereto. Also, it tends to deform and spread the wrench jaws and round and/or crush the fastener corners.

In copending U.S. application Ser. No. 487,921, filed Mar. 5, 1990, there is disclosed an open-end wrench which provides serrated regions on the driving surfaces to increase the gripping force.

However, that wrench still has relatively large jaws, with substantial jaw width, i.e., the dimension between the driving surface and the outer surface of the jaw, and jaw length. More specifically, the jaws are long enough to accommodate both square and hexagonal fasteners. This large jaw size limits the accessibility of the wrench to fasteners located in tight quarters.

SUMMARY OF THE INVENTION

It is a general object of the invention to provide an improved open-end wrenching head which avoids the disadvantages of prior constructions while affording additional structural and operating advantages.

An important feature of the invention is the provision of an open-end wrenching head for a hexagonal fastener which has jaws of reduced size.

In connection with the foregoing feature, another feature of the invention is the provision of an open-end wrenching head of the type set forth, in which the jaws have reduced width and length without sacrificing the gripping force exerted on hexagonal fasteners.

These and other features of the invention are attained by providing a one-piece, open-end wrenching head for a hexagonal fastener having six generally flat sides intersecting at a plurality of corners, the fastener having an across-flats dimension, the wrenching head comprising: a body, and two jaws of substantially equal length on the body and respectively terminating at distal ends, the jaws respectively including driving surfaces spaced apart a predetermined distance slightly greater than the acrossflats dimension of the associated fastener, each of the jaw distal ends being spaced from the inner end of the associated driving surface a distance substantially equal to the length of one of the flat sides of the associated fastener, each of the driving surfaces having at least one serrated region thereon constructed and arranged to engage a portion of a side of the associated fastener.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there are illustrated in the accompanying drawings preferred embodiments thereof, from an inspection of which, when considered in connection with the following description, the invention, its construction and operation, and many of its advantages should be readily understood and appreciated.

FIG. 1 is a fragmentary plan view of a prior art open-end wrenching illustrating its use with associated hexagonal a square fasteners;

FIG. 2 is a reduced plan view of a wrench having an open-end wrenching head constructed in accordance with and embodying the features of a first embodiment of the present invention;

FIG. 3 is a side elevational view of the wrench of FIG. 2;

FIG. 4 is an enlarged, fragmentary view, similar to FIG. 1, of the open-end wrenching head of the wrench of FIG. 2 and illustrating its use with an associated hexagonal fastener; and FIG. 5 is a view, similar to FIG. 4, illustrating an alternative form of the wrenching head of the present invention.

DESCRIPTION OF THE PREFERRED EMBODIMENTS

Referring to FIG. 1, there is illustrated a prior art open-end wrenching head 10 having a body 11 and a pair of jaws 12 and 13, respectively terminating in tips 14 and respectively having opposed driving faces 15 interconnected by an arcuate throat recess 16 formed in the body 11. The wrenching head 10 is adapted for use with either a hexagonal fastener 20, having six equal-length generally flat sides 21 intersecting at equiangularly spaced-apart corners 23, or a square fastener 25, having four substantially flat sides 27 intersecting at corners 29. Each of the fasteners 20 and 25 has an across-flats dimension A. Thus, each of the sides 21 of the hexagonal fastener 20 inherently has a length 0.577A, whereas each of the sides 27 of the square fastener 25 inherently has a length A. Accordingly, the driving faces 15 are spaced apart by a distance slightly greater than the distance A, in standard fashion, and each of the driving faces 15 has a length D1 which is substantially equal to the distance A, so as to be engageable with the sides 27 of the square fastener 25 along substantially the entire length thereof. Because of the length of the jaws 12 and 13, they must also be provided with a substantial width W1, i.e., the distance from the driving face 15 to the outer surface of the jaw as measured at the inner end of the driving face 15, in order to prevent the jaws 12 and 13 from being deformed or spread apart when torque is applied thereto. More specifically, the width W1 is greater than A/2.

Referring now to FIGS. 2 and 3, there is illustrated a one-piece wrench 30 having an elongated handle shank 31 provided at one end with a box wrenching head 35 having a socket opening 37 therethrough, and provided at the other end with an open-end wrenching head 40, constructed in accordance with the present invention. Referring also to FIG. 4, the open-end wrenching head 40 has a body 41 and a pair of jaws 42 and 43 projecting from the body 41 and respectively terminating in tips 44. Generally flat, parallel driving faces 45 are respectively formed on the jaws 42 and 43 in facing relationship and are interconnected by an arcuate throat recess 46 formed in the body 41. Each of the driving faces 45 has a relief region 47 formed thereon at the inner end thereof where it joins the throat recess 46, and is also provided adjacent to the tip 44 with a relief region 48. Each of the driving faces 45 is also provided with a serrated region 50 along the inner half thereof, i.e., the half nearest the throat recess 46. Each of the serrated regions 50 includes a plurality of grooves 51 extending a predetermined depth into the driving face 15 and extending laterally across the entire thickness of the wrenching head 40. The serrated regions 50 may be of the type disclosed in copending U.S. application Ser. No. 487,921, filed Mar. 5, 1990 and entitled "One-Piece, Open-End Wrenching Head with Serrated Jaws", e.g., including three equidistantly spaced-apart grooves.

It is a fundamental aspect of the present invention that each of the driving faces 45 had an overall length which is approximately the same as the length of a side 21 of the associated hexagonal fastener 20, i.e., about 0.577 times the across-flats dimension A. It follows that the driving portion of each of the driving faces 45 has a length D2 which is less than the overall length of the driving face 45 by the length of the relief region 48. The throat recess 46 has a depth sufficient to accommodate a corner 23 of the associated hexagonal fastener 20 which is disposed between the sides 21 engaged by the driving faces 45.

It is another significant aspect of the invention that the deepest point of the throat recess 46 is spaced from an imaginary line connecting the tips 44 by a distance L which is less than the across-flats dimension A of the associated fastener 20, and typically about 0.86A. This is in contrast to the prior art wrenching head 10 in which the distance between the tips 14 and the deepest point of the throat recess 16 was necessarily substantially greater than the across-flats distance A. Furthermore, the serrated regions 50 grip the associated fastener 20 more effectively than the flat wrenching surfaces of conventional prior art open-end wrench designs, such as in the prior art wrenching head 10. Thus, the fastener loads tending to spread the wrench jaws 42 and 43 are significantly lower on the wrenching head 40 than on the prior art wrenching head 10. Accordingly, the jaws 42 and 43 can be constructed with a width W2 which is less than the width W1 of the prior wrenching head 10 and, more specifically less than A/2. The result is a wrenching head with significantly reduced size, having reduced jaw length and width, while still maintaining torque strength levels equal to or better than conventional open-end designs. The reduced length of the jaws 42 and 43 may tend to impair the effectiveness of the wrenching head 40 with the square fasteners 25, but this is considered to be an insignificant disadvantage, since square fasteners are rarely found in present-day automotive and industrial applications.

Referring to FIG. 5 there is illustrated an alternative form of the wrenching head of the present invention, generally designated by the numeral 60. The wrenching head 60 is substantially the same as the wrenching head 40 and, accordingly, like parts bear the same reference numerals. The wrenching head 60 has jaws 62 and 63 which are substantially identical to the jaws 42 and 43, with the exception that the tips are truncated at the inner ends of the relief regions 48 to define coplanar end surfaces 64. This change has the advantage of reducing the overall length of the jaws 62 and 63, i.e., the distance from the deepest point of the throat recess 46 to the plane of the end surface 64, to about 0.8A and it does not impair the effectiveness of the wrench, since the relief regions 48 do not come in contact with the fastener sides 21 in normal operation.

It will be appreciated that other modified forms of the wrenching heads 40 and 60 could be provided, while still adhering to the principles of the present invention. Thus, for example, the throat recess 46 could be provided with straight sides and the serrated regions 50 could be provided on the outer end portions as well as the inner end portions of the driving faces 45, all as disclosed, for example, in the aforementioned copending U.S. application Ser. No. 487,921.

From the foregoing, it can be seen that there has been provided an improved open-end wrenching head which affords a reduced overall size without sacrificing the torque strength levels available for use with hexagonal fasteners.

We claim:

1. A one-piece, open-end wrenching head for a hexagonal fastener having six generally flat sides intersecting at a plurality of corners, the fastener having an across-flats dimension, said wrenching head comprising: a body, and two jaws of substantially equal length on said body and respectively terminating at distal ends, said jaws respectively including substantially parallel driving surfaces spaced apart a predetermined first distance slightly greater than the across-flats dimension of the associated fastener, said body having a throat interconnecting said driving surfaces at the innermost ends thereof, each of said jaw distal ends being spaced from the innermost end of the associated driving surface a second distance substantially equal to 0.577 times said first distance, each of said driving surfaces having at least one serrated region thereon constructed and arranged to engage a portion of a side of the associated fastener, each of said jaws having a width less than one-half said first distance, the width being measured perpendicular to the associated driving surface at the innermost end thereof.

2. The wrenching head of claim 1, wherein each of said driving surfaces has a length less than said second distance.

3. The wrenching head of claim 1, wherein each of said jaws includes a relief region thereon adjacent to the distal end thereof.

4. The wrenching head of claim 1, wherein each of said jaws includes a relief region thereon at the innermost end of its driving surface which does not contact the associated fastener in use.

5. The wrenching head of claim 1, wherein each of said driving surfaces terminates at the distal end of the associated jaw.

6. The wrenching head of claim 1, wherein said throat is dimensioned to accommodate a corner of an associated fastener when opposed sides thereof are respectively disposed along said driving surfaces.

7. The wrenching head of claim 1, wherein each of said serrated regions occupies only a portion of the length of the associated driving surface.

8. The wrenching head of claim 7, wherein each of said serrated regions is disposed along only the half of the associated driving surface farthest from the distal end of the associated jaw.

9. The wrenching head of claim 7, wherein each of said serrated regions includes three equidistantly spaced-apart grooves extending transversely across the face of the associated driving surface.

10. The wrenching head of claim 6, wherein said throat is arcuate in shape.

11. The wrenching head of claim 6, wherein a third distance between the deepest point of said throat and an imaginary line joining the distal ends of said jaws is less than said first distance.

12. The wrenching head of claim 11, wherein said third distance is about 0.86 times said first distance.

* * * * *